US005791381A

United States Patent [19]

Lepka et al.

[11] Patent Number: 5,791,381

[45] Date of Patent: Aug. 11, 1998

[54] PROCESS FOR DETERMINING THE ARRANGEMENT AND THE STEP SEQUENCE OF HEALD SHAFTS OF A HEALD LOOM

[75] Inventors: Klaus Peter Lepka, Krefeld; Detlef Förster, Krefeld-Hüls; Wolfgang Thomas, Krefeld; Rainer Begoghina, Bochum, all of Germany

[73] Assignee: EAT Elektronische Ateliertechnik Textil GmbH, Kempen, Germany

[21] Appl. No.: 579,865

[22] Filed: Dec. 28, 1995

[30] Foreign Application Priority Data

Dec. 29, 1994 [DE] Germany ..... 44 46 957.8

[51] Int. Cl.[6] ..... D03C 19/00

[52] U.S. Cl. ..... 139/68; 139/319; 139/55.1; 364/470

[58] Field of Search ..... 139/1 R, 68, 319, 139/78, 55.1; 364/470

[56] References Cited

U.S. PATENT DOCUMENTS

| | | | |
|---|---|---|---|
| 4,893,250 | 1/1990 | Sainen | 139/1 R |
| 5,200,904 | 4/1993 | Tottman | 139/1 R |

FOREIGN PATENT DOCUMENTS

| | | | |
|---|---|---|---|
| 0049105 | 4/1982 | European Pat. Off. | 139/55.1 |
| 0280636 | 8/1988 | European Pat. Off. | 139/319 |
| 0692562 | 1/1996 | European Pat. Off. . | |
| 42 35 487 | 4/1994 | Germany | 139/319 |
| 405263333 | 10/1993 | Japan | 139/1 R |

OTHER PUBLICATIONS

European Search Report of No. EP 95 11 8027, Apr. 173 1996.

*Primary Examiner*—Andy Falik

*Attorney, Agent, or Firm*—John F. A. Earley; John F. A. Earley III

[57] ABSTRACT

A process for determining the arrangement and step sequence of heald shafts of a heald loom for weaving a fabric including a backing fabric having a fabric pattern and an ornamental design. The ornamental design of the fabric is plotted and/or displayed by means of a computer. Alternatively, the combined appearance of the ornamental design and the fabric pattern may be plotted and/or displayed. Next, the number of heald shafts necessary for weaving the ornamental design or the combined appearance is determined. Heald shaft arrangements that are conventionally used and/or available which will weave a fabric design similar to the ornamental design or the combination designed are plotted and compared with the heald shafts determined for weaving the ornamental design or the combination design. The step sequence of the individual heald shafts in the heald loom from the assigned heald shaft arrangement is determined. Finally, the resultant fabric design with the determined heald shaft arrangement and step sequence is displayed and/or woven on an output unit.

12 Claims, 3 Drawing Sheets

PROCESS FOR DETERMINING THE ARRANGEMENT AND THE STEP SEQUENCE OF HEALD SHAFTS OF A HEALD LOOM

FIELD OF THE INVENTION

The present invention pertains to a process for determining the arrangement and the step sequence of heald shafts of a heald loom for a fabric that comprises a backing fabric having a design and that is to be woven.

BACKGROUND OF THE INVENTION

The heald shaft weaving technique, in which a large number of threads is always raised or lowered at the same time, is widely used in weaving technology. In this case, threads are brought together into larger groups, such that large-surface and finely drawn designs cannot be produced as in the case of the jacquard technique, and the number of designs is limited. The heald shaft weaving technique is used, however, in the case of simple designs.

The individual heald shafts lie behind one another in the loom. During the weaving, the so-called triangular warp is shed by means of the raised warp threads, by means of the lowered warp threads and the reed. The heald shaft at the very back must be raised very high so that it still reaches the same angle as the heald shaft at the very front during shedding by means of raising the warp threads. Due to physical limitations, the number of heald shafts that can be mounted in a loom is limited. No more than 40 heald shafts can be used in the looms that are currently employed, and the use of more than 24 heald shafts rarely occurs.

Due to the limitation of the number of heald shafts, the number of designs is also limited. The appearance of heald-shaft-designed fabrics depends on the number and the arrangement, as well as on the step sequence of the heald shafts.

In the production of a new fabric designed by heald shafts, the fabric to be woven with a design is "tried out" by means of replacing individual heald shafts. It is often necessary to replace many heald shafts. It is also not always guaranteed in this case that the new fabric with a design also corresponds to the design that is used as the pattern. The "trying out" of a new heald-shaft-designed fabric is very time-consuming and expensive, because the heald shafts of a loom must be replaced manually and the drawing-ins of the individual heald shafts must thus be changed.

SUMMARY OF THE INVENTION

The basic object of the present invention is to demonstrate a process of the above-mentioned type, in which a fabric having a new design is able to be produced in, a simple and less expensive manner, wherein the appearance of this fabric should—at least to a great extent—correspond to the pattern.

In attaining this object, it is taken into consideration that there are various looms having different heald shaft arrangements or sets of heald shafts having specific heald shaft arrangements, with which different designs have already been woven. The replacement of the individual sets of heald shafts is relatively simple, because the heald shafts are replaced as a whole, and the drawing-in of the individual heald shafts is not changed.

Based on this finding, the process for determining the arrangement and step sequence of heald shafts of a heald loom for a fabric that comprises a backing fabric having a design and that is to be woven, runs according to the process steps of claim 1. Thus:

a pattern for a design or a backing fabric having a design is plotted and/or displayed by means of a computer, the number of the heald shafts necessary for weaving the pattern is determined, heald shaft arrangements that are known and/or available are plotted, the heald shafts determined for weaving the pattern are compared with the plotted heald shaft arrangements and are assigned to these [heald shaft arrangements], the step sequence of the individual heald shafts in the heald loom is determined from the heald shaft arrangements assigned in this manner, and with the determined heald shaft arrangement and the step sequence, a fabric having a design is able to be displayed and/or woven on an output unit.

The fabric, which is to be woven after determining the arrangement and the movement of the heald shafts, comprises a backing fabric having a design. The design is displayed on a pattern. If the backing fabric also has its own design, this [design] is also displayed on the pattern. This pattern can, e.g., be scanned in. However, it is also possible to display this pattern directly on the screen.

DESCRIPTION OF A PREFERRED EMBODIMENTS OF THE INVENTION

Reference is made to the attached, schematic FIGS. 1*a*, *b* and 2*a*, *b* and 3 in the description below to better illustrate the process.

Figure 1B:
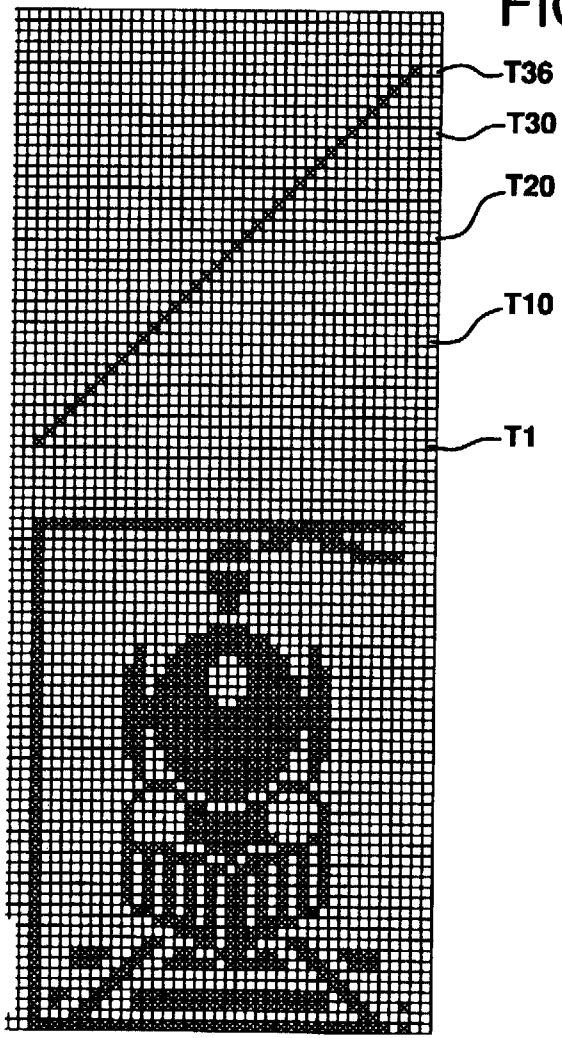
FIG. 1*b* shows the step sequence of a heald shaft arrangement and the peg plan for weaving the pattern of FIG. 1*a* in accordance with an embodiment of the present invention.
Figure 1A:
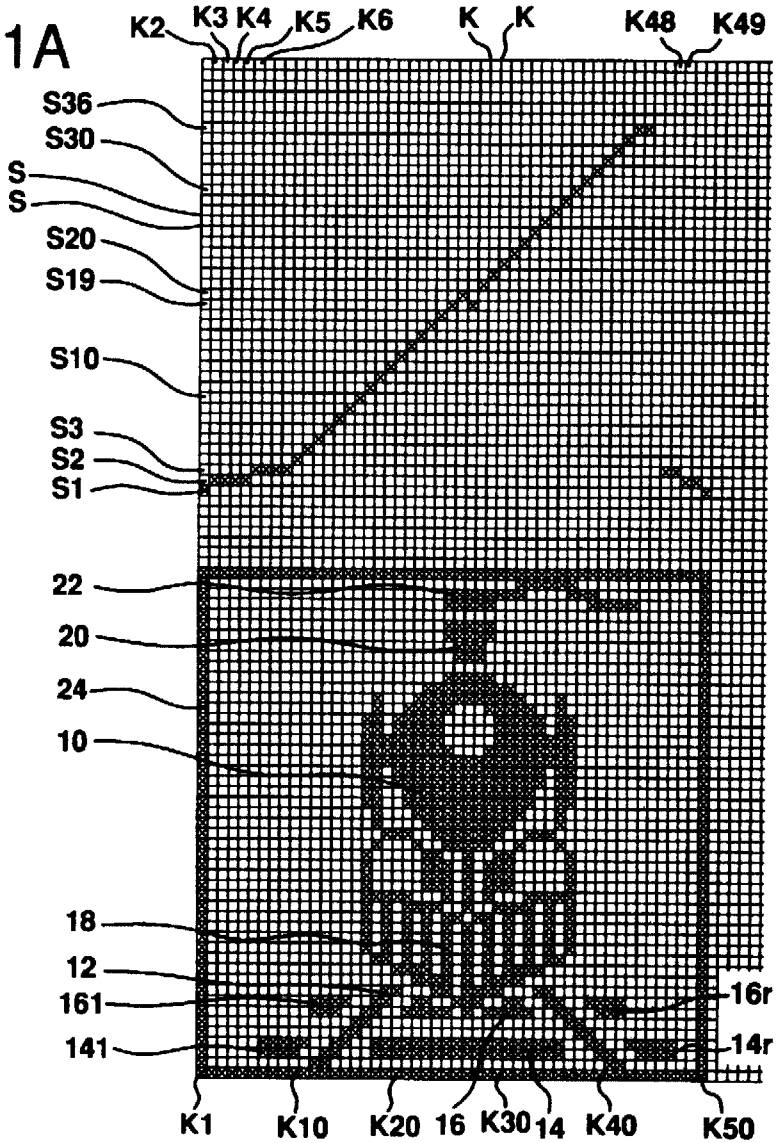
FIG. 1*a* shows a fabric pattern to be woven in accordance with an embodiment of the present invention.

The lower area of FIG. 1*a* shows a pattern for a design (the so-called fabric appearance). The design essentially comprises a locomotive 10 on a track 12 shown in the front view. Visible from the track 12 are two railroad ties 14, 16, from which two areas 14*l*, 14*r* and 16*l*, 16*r*, respectively, project laterally over the track 12.

On its front end, the locomotive 10 has a pusher 18, and up on top, it has a smokestack 20, from which a smoke plume 22 rises. The entire subject is bordered by a square 24. The pattern comprises only one design in this exemplary embodiment. No special design is given for the basic design of the fabric to be woven.

Figure 3:
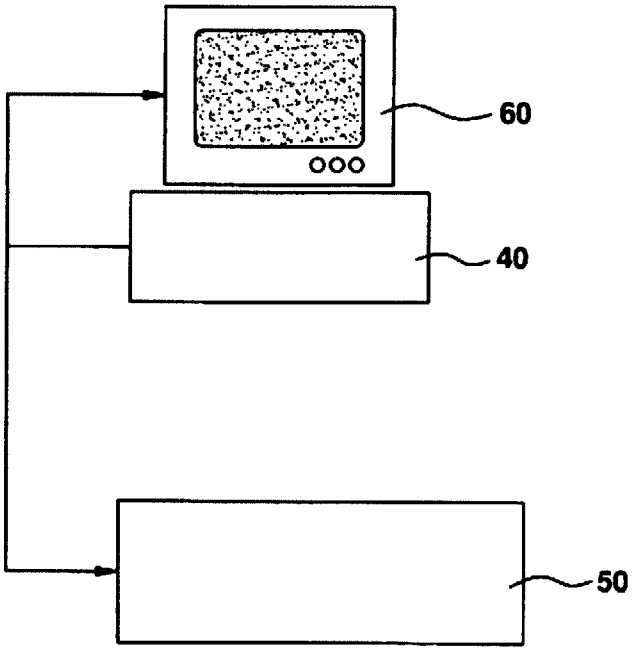
FIG. 3 is a schematic diagram of a computer, display and output unit which may be used in accordance with an embodiment of the present invention.

The design of the pattern is plotted by means of a grid. Cartesian coordinates may be assigned to the individual scanning elements, so that the design can be plotted in the computer 40 shown in FIG. 3. Other processes for plotting the design are also conceivable.

A heald shaft drawing-in for a heald shaft arrangement is shown in the upper area of FIG. 1*a*. The space between two vertical lines K denotes the warp thread controlled by a heald shaft, and the space between two horizontal lines S denotes the respective shaft. The number of the heald shafts depends on the number of different weaving warp threads. Assuming that one heald shaft is needed for each warp thread in the repeat, the maximum necessary number of heald shafts corresponds to the number of warp threads in the repeat. A reduction in the number of heald shafts is possible as a result of all the equally weaving warp threads being placed on one heald shaft, without the design of the fabric being changed because of this. In FIG. 1*a*, in determining the number of heald shafts, it is already assumed that equally weaving warp threads are placed on one heald shaft.

The design of the pattern comprises 50 warp threads, wherein the first warp thread K1 corresponds to the left vertical delimitation of the square 24 and the fiftieth warp thread K50 forms the right vertical delimitation of the square 24.

The heald shafts, which are characterized by means of the horizontally running areas between every two lines S, are numbered consecutively below to simplify the description, wherein the heald shaft S1 is characterized by the lowest horizontal area. Thirty-six different heald shafts (S1 through S36) are necessary for the subject.

The number of shafts that are necessary for weaving the locomotive 10 is determined for the locomotive 10 of the design in FIG. 1*a*. The heald shaft S1 controls both the first (K1) and the fiftieth warp thread (K50), and the heald shaft S2 controls the warp threads K2, K3, K4, K5, K6, K48, and K49. Accordingly, the heald shafts S3, S19 and S36 also control a plurality of warp threads, whereas the remaining heald shafts only control one warp thread each.

Various designs with specific shaft arrangements have been woven with currently available looms already. These designs are plotted as a function of the respective heald shaft arrangement by means of the computer. It is also possible for the respective design to be stored already in the computer.

The heald shaft arrangement, which has been determined for the locomotive 10, is compared to the known heald shaft arrangements that have been plotted by means of the computer. Thus, that heald shaft arrangement, which either agrees with a specific heald shaft arrangement for the locomotive 10 or comes so close to this arrangement that the loss of information is as low as possible, that is, the locomotive 10 is woven at some future date, such that the deviations of the heald-shaft-designed fabric from the pattern are as low as possible, is picked out from the known heald shaft arrangements.

In connection thereto, the sequence, in which the heald shafts are triggered (the so-called step sequence), is determined for the determined heald shaft arrangement. This is shown in FIG. 1*b* and is designated as T1 through T36.

By means of this step sequence and the peg plan resulting from this, which is shown in the lower section of FIG. 1*b*, the fabric having a design is displayed on an output unit, e.g., by means of a printer 50, or on a screen 60, or is woven on a loom. In case of weaving, the loom that already contains the available heald shaft arrangement is selected, or a set of heald shafts that contains the desired heald shaft arrangement is selected. It is possible to replace this set of heald shafts with an available set of heald shafts of a loom.

Compared with the prior-art heald shaft weaving technique, the advantage of the present process is that it is no longer necessary to replace individual heald shafts manually. Rather, known heald shaft arrangements are used, whereby costs are saved. Moreover, an exact determination of the heald-shaft-designed fabric is already possible before the weaving, so that the time-consuming "trying out," i.e., weaving on a trial basis, is omitted.

As already described, the number of the heald shafts in a loom is limited. More heald shafts than are available on a loom are often necessary for weaving complicated designs. So that such designs—at least roughly—can be woven, the process according to the present invention is characterized in that a specific number of heald shafts, which may not be exceeded, is determined beforehand. The number of heald shafts necessary for weaving the pattern (fabric appearance) is reduced to this predetermined number.

Figure 2B:
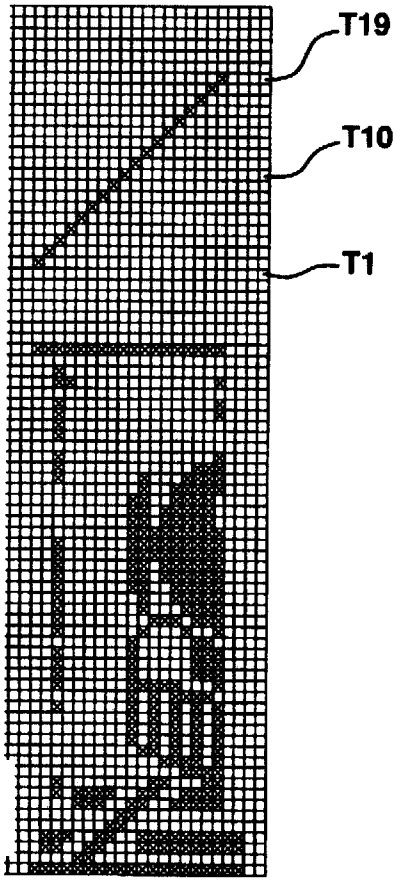
FIG. 2*b* shows the step sequence and peg plan for weaving the pattern of FIG. 2 in accordance with an embodiment of the invention.
Figure 2A:
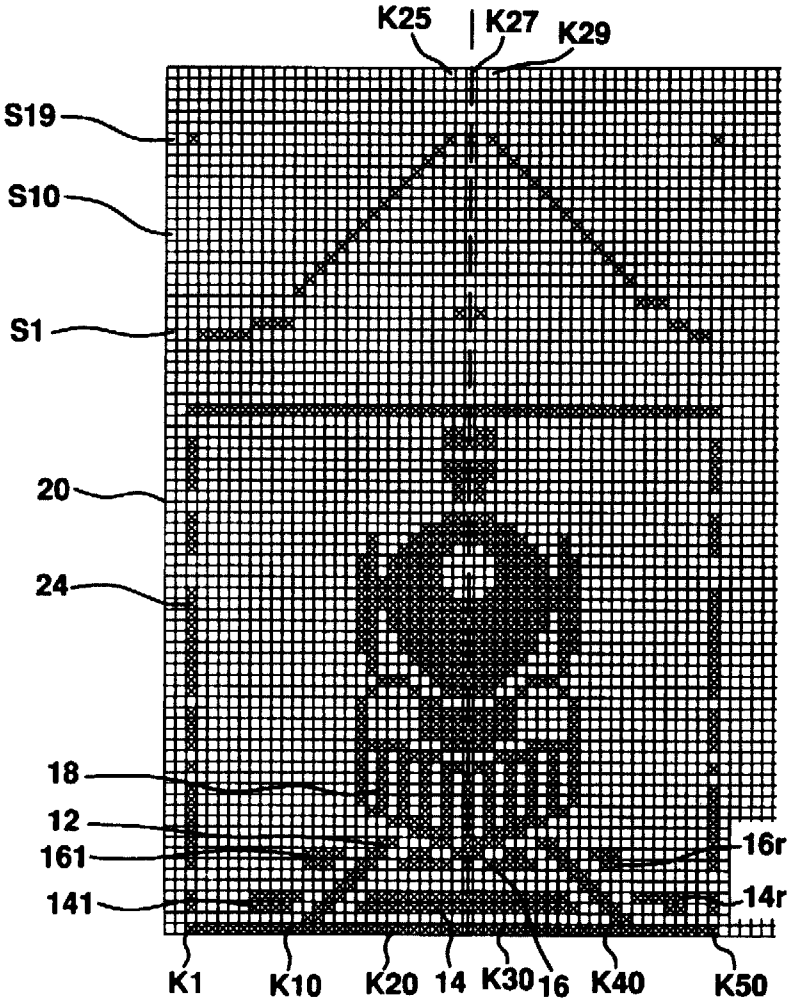
FIG. 2*a* shows an example of a fabric pattern from a heald shaft arrangement having a reduced number of heald shafts.
Figure 4:
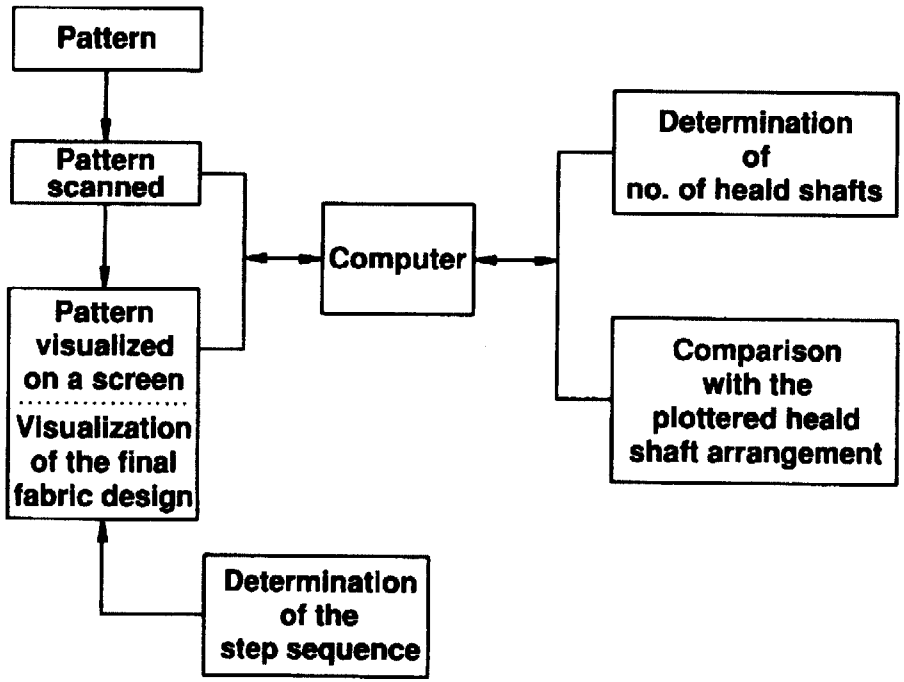
FIG. 4 is a flow diagram of the process of the present invention.

A possible reduction in the number of heald shafts is shown in FIG. 2*a*. In this reduction, the design is scanned along the warp threads, in this case from right to left. Individual heald shafts are thereby removed. The design is changed such that the number of heald shafts is reduced, and at the same time, it is taken into consideration that the loss of information is as low as possible, such that the pattern (the fabric appearance) shows only small deviations from the design changed by means of removing individual warp threads.

Among other things, the smoke plume 22 has been removed in the locomotive 10 in FIG. 2*a*, since—with minimal loss of information—a considerable number of heald shafts is unnecessary as a result of this. Overall, the pattern has been changed such that the design is extensively symmetrical along the axis of symmetry A. The number of heald shafts is thereby reduced accordingly.

In this "symmetrical" design, the warp threads lying to the left of the axis of symmetry A can be controlled by the same heald shafts as the warp threads lying to the right of the axis of symmetry A. It is evident from this that the number of heald shafts in a symmetrical design can be considerably reduced.

Nineteen heald shafts are still necessary for this design. The heald shaft S1 in FIG. 1*a* for controlling the warp threads K1 and K50 has been removed. According to FIG. 2*a*, these warp threads are controlled by the heald shaft S19, which likewise controls the warp threads K25, K27 and K29. By means of removing other heald shafts, the number of heald shafts has been reduced to 17 heald shafts. As a result of this, only slight changes appear in the design, such as the omission of the smoke plume 22. The vertically running lines of the square 24 are, e.g., broken. Compared with the design in FIG. 1*a*, the loss of information of the design in FIG. 2*a* is minimal.

With the change in the design, the heald shaft arrangement also changes, as is shown in the upper section of FIG. 2*a*. If a heald shaft arrangement, which is new, is developed for a pattern, then it is possible, due to slight variations in the design, to determine a heald shaft arrangement, which is already available or is at least approximate.

Accordingly, the heald-shaft-designed fabrics produced with the determined heald shaft arrangement and the step sequence show a good agreement with the pattern. If deviations from the pattern appear, they are minimal. The agreement of the fabric having a design with the pattern is dependent on the number of predetermined heald shaft arrangements, as well as on the design woven with these heald shaft arrangements. The sum of the known heald shaft arrangements is proportional to the agreements between the fabric appearance according to the draft and the final fabric appearance.

The appearance of the final heald-shaft-designed fabric in the process described is already determined in the predraft zone of the weaving, without an expensive weaving on a trial basis being necessary.

A good plotting of the pattern can be achieved as a result of the backing fabric being plotted as background information and the design being plotted as foreground information. The backing fabric extends over the entire fabric, whereas the design only appears in some sections of the fabric. An exact plotting of the pattern and a reliable assignment of the heald shafts to the design and to the backing fabric are guaranteed by this division into foreground and background information.

Additional filling patterns or warp patterns may be assigned to the design. In the case of an additional filling pattern and of an additional warp pattern, additional heald shafts are possibly to be provided with a warp thread for the design, if the warp thread is not already present on a heald shaft. A filling pattern, a warp pattern and/or a filling and warp pattern may be assigned to a design. Thus, the heald shafts are assigned and the step sequence is selected in a similar manner as described above.

Good final results for the woven fabric may also be achieved by comparing the heald-shaft-designed fabric, which is displayed and/or woven with the determined heald shaft arrangement and step sequence, with the original fabric appearance. In this case, corrections may still be made, if the results should demonstrate undesired deviations from the original fabric appearance. If the fabric having the determined heald shaft arrangement and step sequence is made visible, for example, on a screen or by means of a printer, a "sample weaving" is completely omitted, so that considerable costs and time are saved.

In the process according to the present invention, it is also possible for one or more kinds of weave to be predetermined for the fabric. The appearance of the fabric that is to be woven may be influenced by this.

Tracing the heald shaft arrangement determined for the weaving of the fabric with the design to a known heald shaft arrangement may be achieved by means of permutating the necessary heald shafts. If a determined heald shaft arrangement is not available on a loom or as a set of heald shafts, the individual heald shafts are exchanged with each other such that the arrangement of the heald shafts and thus the heald shaft arrangement change. The appearance of the design is not changed. These heald shaft permutations are made until a known heald shaft arrangement is determined. If a known heald shaft arrangement cannot be determined by means of the heald shaft permutations, the heald shaft arrangement, which corresponds to the initial situation of the heald shaft arrangement, is selected in the permutations.

The appearance of the heald-shaft-designed fabric to be woven is additionally able to be influenced by specific kinds of weaves being assigned to individual colors and/or to individual design sections of the fabric.

If the fabric to be woven is to be made visible on an output unit, a good comparison with the pattern is possible if the colors for the fabric are selected as a function of the colors that can be displayed with the output unit.

It is evident from FIG. 2*b* that the change in the heald shaft arrangement according to FIG. 2*a* as compared with FIG. 1*a* leads to a correspondingly changed step sequence (upper section of FIG. 2*b*). The associated peg plan can be seen in the lower section of FIG. 2*b*.

The process according to the present invention may also be combined with a process for displaying a fabric comprising warp threads and filling threads, as has become known, e.g., from European Patent Application No. 94110818.5. In this prior-art process, fabrics are simulated on a screen taking into consideration various effects that influence the appearance of a fabric.

The process steps are not limited to the embodiments described. Other embodiments of the individual process steps are also possible as long as the same results are obtained. Additional features of the present invention appear from the features of the subclaims, as well as from the other application documents.

We claim:

1. Process for determining the arrangement and the step sequence of heald shafts of a heald loom for weaving a fabric comprising a backing fabric having a fabric pattern and an ornamental design, said process comprising the following steps:

1.1 plotting and/or displaying by means of a computer the ornamental design of the fabric, or the combined appearance of the ornamental design and the fabric pattern, 1.2 determining the number of the heald shafts necessary for weaving said ornamental design or said combined appearance, 1.3 plotting the heald shaft arrangements that are conventionally used and/or available which will weave a fabric design similar to the ornamental design or said combined appearance, 1.4 comparing the heald shafts determined for weaving said ornamental design or said combined appearance with the plotted heald shaft arrangements and assigning the heald shafts determined for weaving said ornamental design or said combined appearance to these heald shaft arrangements, 1.5 determining the step sequence of the individual heald shafts in the heald loom from the assigned heald shaft arrangements, and 1.6 displaying and/or weaving on an output unit the resultant fabric design with the determined heald shaft arrangement and the step sequence.

2. Process in accordance with claim 1, including the step of reducing the number of heald shafts determined for weaving said ornamental design or said combined appearance to a preset number of heald shafts.

3. Process in accordance with claim 1, including the step of plotting said ornamental design or said combined appearance, which is plotted and/or displayed by the computer, by means of Cartesian coordinates.

4. Process in accordance with claim 1, including the step of plotting the pattern of the backing fabric as background information and plotting the ornamental design as foreground information.

5. Process in accordance with claim 1, including the step of assigning additional filling and/or warp patterns to said ornamental design or said combined appearance.

6. Process in accordance with claim 1, including the step of comparing the fabric which is displayed and/or woven with the determined heald shaft arrangement and the step sequence, with said ornamental design or said combined appearance.

7. Process in accordance with claim 1, including the step of predetermining the fabric pattern.

8. Process in accordance with claim 1, including the step of tracing the heald shafts necessary for weaving the fabric to known heald shaft arrangements by means of permutations.

9. Process in accordance with claim 1, including the step of assigning specific fabric patterns to individual colors and/or individual design sections of the fabric.

10. Process in accordance with claim 1, including the step of selecting the fabric colors as a function of the colors that can be displayed on the output unit heald shaft arrangement and the step sequence on the output unit.

11. Process in accordance with claim 1, including the step of scanning in or displaying directly said ornamental design or said combined appearance on a screen.

12. The process of claim 1, including the step of reducing the number of heald shafts determined for weaving said ornamental design or said combined appearance to a preset number of heald shafts, including the step of plotting said ornamental design or said combined appearance, which is plotted and/or displayed by the computer, by means of cartesian coordinates, including the step of plotting the pattern of the backing fabric as background information and plotting the ornamental design as foreground information, including the step of assigning additional filling and/or warp patterns to said ornamental design or said combined appearance, including the step of comparing the fabric, which is displayed and/or woven with the determined heald shaft arrangement and the step sequence, with said ornamental design or said combined appearance, including the step of predetermining the fabric pattern, including the step of tracing the heald shafts necessary for weaving the fabric to known heald shaft arrangements by means of permutations, including the step of assigning specific weaves to individual colors and/or individual design sections of the fabric, including the step of selecting the fabric colors as a function of the colors that can be displayed on the output unit when displaying the fabric shown from the determined heald shaft arrangement and the step sequence on the output unit, and including the step of scanning in or displaying directly the ornamental design or the combined appearance on a screen.

* * * * *